US005259693A

United States Patent [19]

Raymond

[11] Patent Number: 5,259,693

[45] Date of Patent: Nov. 9, 1993

[54] METHOD AND APPARATUS FOR HEATING AN ASPHALT PAVING SCREED

[75] Inventor: Larry Raymond, Tacoma, Wash.

[73] Assignee: Carlson Paving Products, Inc., Tacoma, Wash.

[21] Appl. No.: 847,648

[22] Filed: Mar. 6, 1992

Related U.S. Application Data

[63] Continuation-in-part of Ser. No. 577,615, Sep. 4, 1990, Pat. No. 5,096,331.

[51] Int. Cl.[5] ..... E01C 23/14; E01C 19/22

[52] U.S. Cl. ..... 404/95; 404/118

[58] Field of Search ..... 404/91-92, 404/95-96, 114, 118; 62/23; 426/388, 453; 165/35, 104.19, 108; 432/36-37, 47

[56] References Cited

U.S. PATENT DOCUMENTS 3,557,672 1/1971 Shurtz ..... 404/95
3,864,858 2/1975 Rochfort ..... 404/98
3,997,276 12/1976 Jackson, Sr. ..... 404/95 X
4,018,540 4/1977 Jackson, Sr. ..... 404/95
4,319,856 3/1982 Jeppson ..... 404/92 X
4,714,374 12/1987 Mihara ..... 404/91

*Primary Examiner*—Kenneth J. Dorner
*Assistant Examiner*—Nancy P. Connolly
*Attorney, Agent, or Firm*—Seed and Berry

[57] ABSTRACT

Heat exchange tubes are mounted on the upper face of the sole plates of the main screed and screed extenders on an asphalt paving machine. Hot oil is circulated through the heat exchange tubes to preheat the sole plates. The heating system for the oil includes a pressure drop across a flow restrictor. The heating oil is pressurized by a pump driven by a hydraulic motor supplied with pressurized oil in a second hydraulic circuit from the tractor of the paver. This second circuit is also used to operated the vibratory mechanisms on the screeds after the screeds are preheated.

19 Claims, 5 Drawing Sheets

ASPHALT PAVING MACHINE

METHOD AND APPARATUS FOR HEATING AN ASPHALT PAVING SCREED

This application is a continuation-in-part of my copending U.S. patent application Ser. No. 07/577,615 dated Sep. 4, 1990 now U.S. Pat. No. 5,096,331.

TECHNICAL FIELD

The present invention relates to asphalt paving machines, and particularly to means for preheating primary screed sections and screed extenders.

BACKGROUND OF THE INVENTION

As discussed in my previous application, identified above, the sole plates of screeds on asphalt paving machines must be preheated to about 175° F. to 200° F. before paving commences to keep the hot asphalt from congealing on the sole face of the screeds. In the past, the preheating has been accomplished by oil or propane burners mounted on the moldboard and directly heating the top surface of the screeds. When using such burners, particular care must be taken to avoid overheating since this can result in permanent warping of the screed.

U.S. Pat. No. 4,818,140 discloses a screed extension which is slide-mounted on the moldboard of an asphalt paver of the floating screed type. The screed extension is divided into inner and outer screed sections which are hinged together so that the outer screed section can be swung upwardly relative to the inner screed section to engage and shape a sloping berm. Prior to the heating system disclosed in my previous application, screed extensions have not been independently heated because the preheating system normally used for the main screed was not considered to be adaptable for screed extensions.

My prior invention provided an improved preheating system applicable to both primary and extension screeds which eliminated the use of oil or propane burners by utilizing the heat created by dropping the pressure of high pressure oil at a flow restrictor. A reservoir was mounted in direct contact with the top surface of the screed, and oil from the reservoir was pressurized by a pump and circulated through a flow restrictor to create a large pressure drop. This pressure drop can be adjusted to result in an output oil temperature of about 275° F. which normally is sufficient to establish the desired screed temperature of about 200° F.

SUMMARY OF THE INVENTION

The present invention is aimed at improving my prior invention to the extent of reducing the amount of heating oil required in the system so as to speed up the heating cycle, and eliminating the utilization of reservoirs at the top of the screeds. This objective has been accomplished by attaching flat-sided heat exchange tubes directly to the upper surface of the screeds through which the heated oil is circulated.

In the preferred operation of the present invention for an asphalt paver having a main floating screed equipped with screed extensions and towed by a tractor, a hydraulic pump on the tractor supplies pressurized oil to a control unit on the primary screed from which the oil is selectively distributed to drive hydraulic motors in the heating and vibratory systems for the screeds. The hydraulic motor in the heating system drives a high pressure pump whose output is circulated in a closed independent system through a flow restriction causing the circulating oil to be heated responsive to the resulting pressure drop. Heated oil is circulated through heat exchange tubes mounted on the sole plates of the screeds and returns to a small reservoir tank from which the high pressure pump takes its suction. A temperature sensor is provided in the heating system to detect overheating of the components and causes most of the oil supplied to the hydraulic motor in the heating system to be cut off in the control manifold when an overheating condition is sensed. After the screeds are heated the pressurized oil from the tractor is diverted at the control manifold to hydraulic motors in the vibratory system which drive eccentric carrying shafts mounted on the screed units.

DETAILED DESCRIPTION OF THE INVENTION

Figure 4:
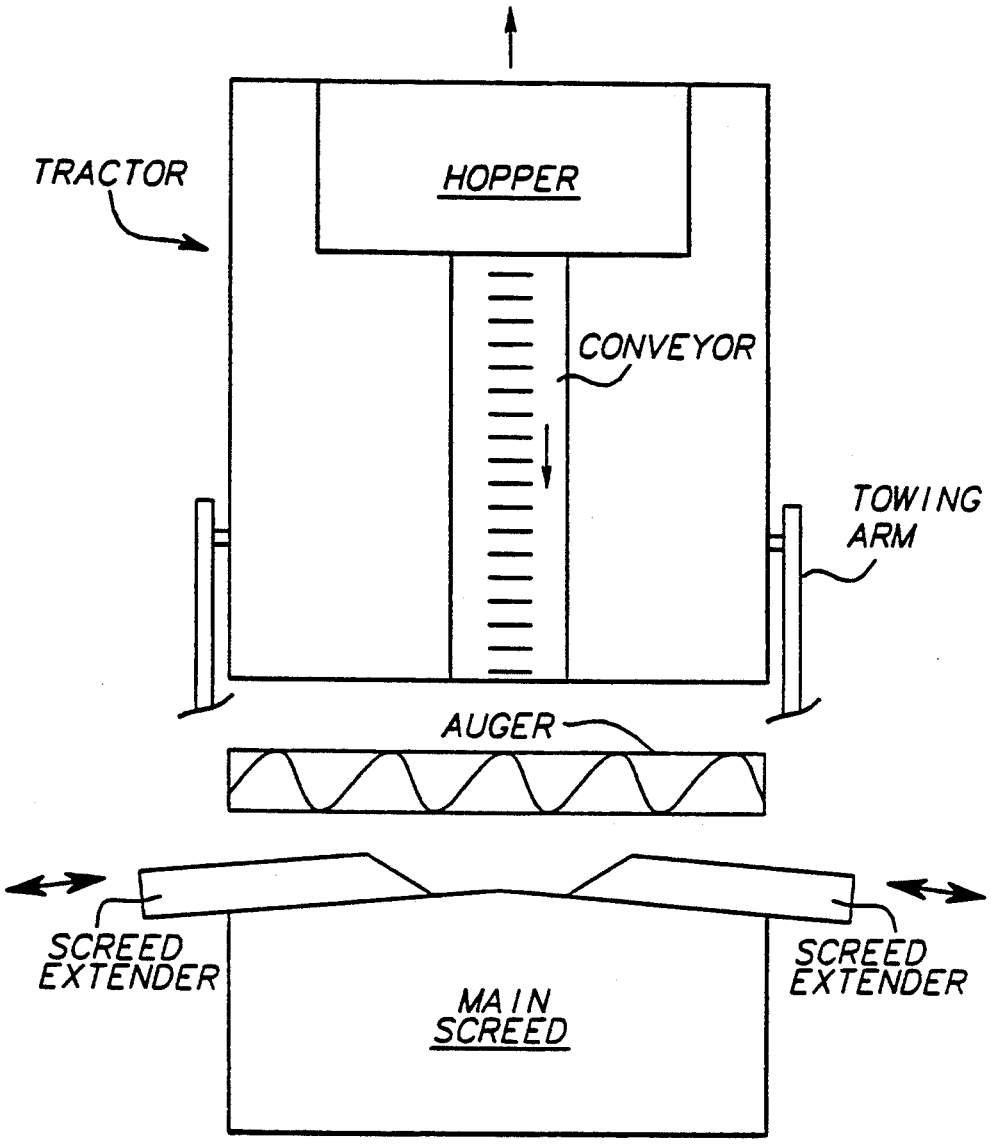
FIG. 4 is a schematic plan view of an asphalt paving machine.
Figure 5:
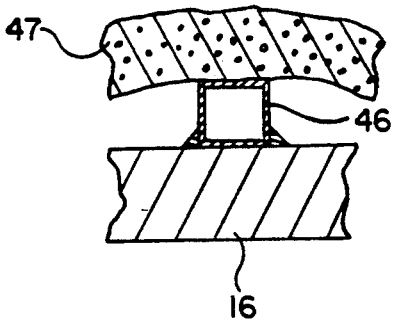
FIG. 5 is an enlarged detail sectional view taken as indicated by line 5—5 in FIG. 3.

The general layout of an asphalt paving machine with a floating main screed equipped with adjustable screed extenders which is towed by a tractor is shown in FIG. 4. Hot asphalt paving material is fed by one or two conveyers from a front hopper on the tractor to an auger carried by the tractor between the tractor and the main screed.

The main screed unit has a pair of side-by-side frame sections 10, 11 each comprising an outer generally triangular side plate 12, an inner gusset plate 13, a deck plate 14, and a front moldboard 15. Each deck plate 14 has an upturned front flange **14*a* which is partly overlapped by the respective moldboard 15, and each moldboard has a rearwardly extending top flange 15*a* which overlaps a flat upper edge portion of the respective side plate 12. The side plates 12 and gusset plates 13 are welded in position to the deck plates 14 and moldboards 15 and the moldboards are welded to the front flange 14*a* of the deck plates 14. Near the rear each deck plate 14 bends downwardly and has a back lip 14*b*** which has a gentle upward slope.

Figure 3:
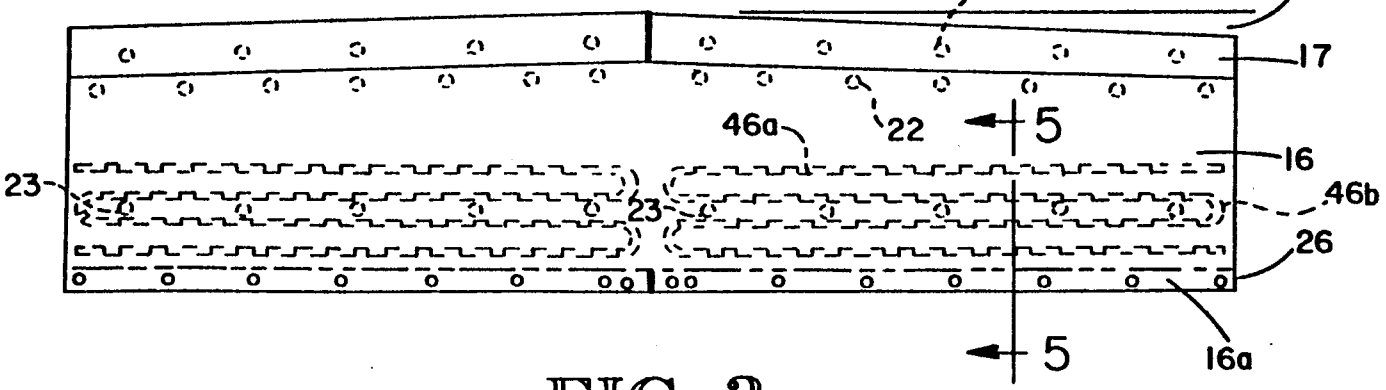
FIG. 3 is a bottom plan view of the screed unit.

The main screed unit also has a sole plate 16 and a pair of side-by-side front bullnose members 17 bent from plate stock. The front edge of the sole plate is tapered laterally in both directions from the center so as to slope rearwardly toward both sides of the screed unit as best seen in FIG. 3. Hence, the front edge of the sole plate has a convex V-shape. This convex V-shape is matched by the back edges of the bullnose members 17 which together provide a concave V-shape. The bullnose sections 17 extend from the sole plate 16 forwardly a short distance by bottom flanges **17*a* and then have a rounded nose portion 17*b* which joins an upturned flange 17*c* which overlaps the respective deck plate flange 14***a* below the respective moldboard element. The front taper angle 19 (FIG. 3) of the screed is preferably about three to five degrees, for example.

Figure 1:
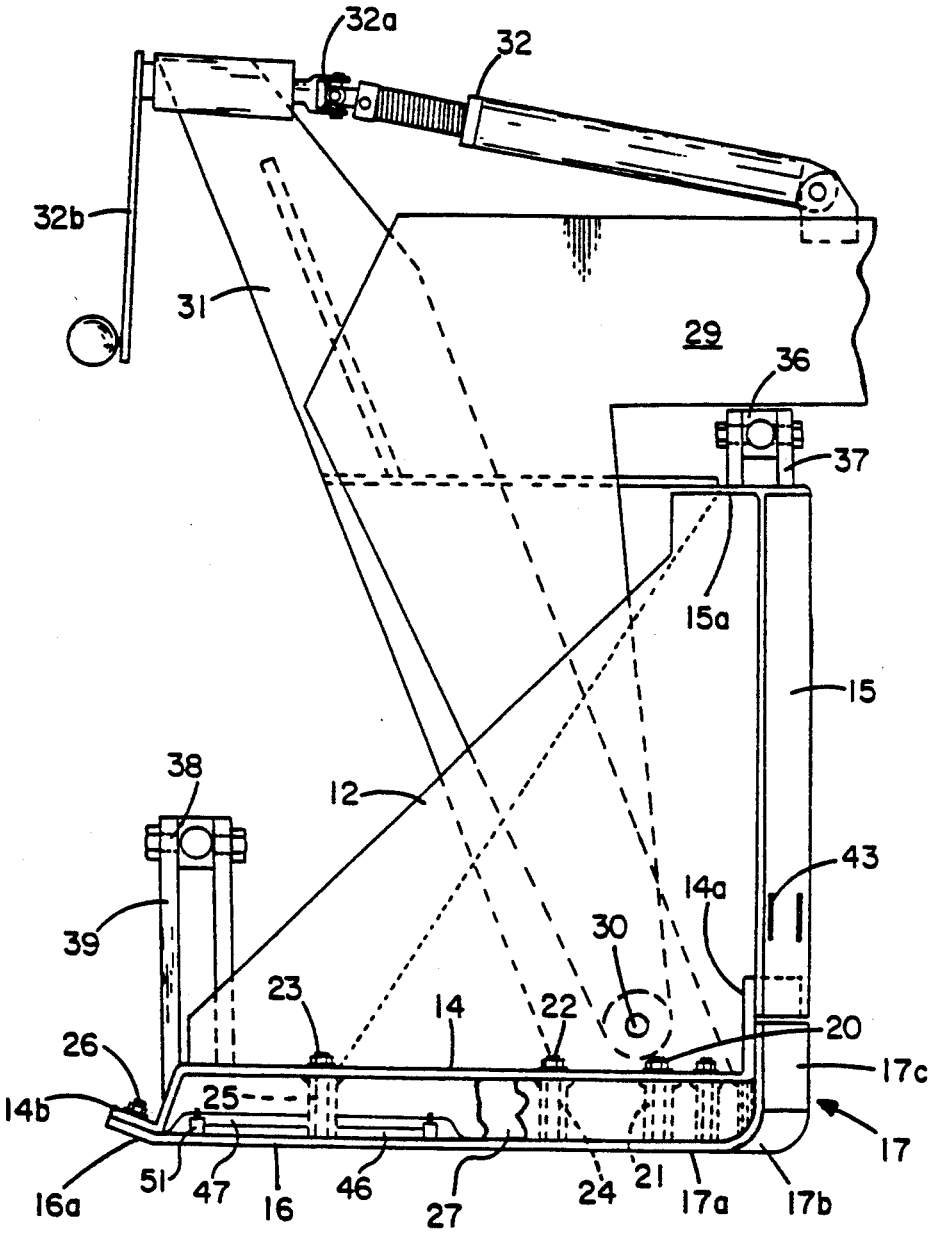
FIG. 1 is an end view of a main screed unit on the paving machine embodying the present invention.

The bullnose members 17 are held in position by a row of studs 20 which are anchored to the sole plate 16 and pass through tubular spacers 21 seated between the bottom flanges 17*a* of the bullnose members 17 and the deck plate 14. Nuts on the studs 20 seat against the upper face of the deck plate 14. Similarly, the sole plate 16 is held in position by front and intermediate rows of studs 22, 23 and respective spacers 24, 25 and by rear bolts 26 which connect the back lip 14*b* on the deck plates to a matching lip 16*a* sloping upwardly at the rear of the sole plate 16. The space between the sole plate 16 and the deck plate 14 is closed by end covers 27 shown fragmentarily in FIG. 1.

The screed unit is towed from a tractor by a pair of laterally spaced drag arms 29 of general L-shape which are pivotally connected to the tractor adjacent their forward ends and are pivotally connected to the screed unit by pins 30 extending through the side plates 12 and a pair of upstanding lever arms 31 which are welded at their lower ends to the deck plates 14. Jack screws 32 with universals 32*a* and operating handles 32*b* connect the upper ends of the lever arms 31 to the drag arms 29 so that the lever arms can be pulled forwardly or pushed rearwardly relative to the drag arms 29 to thereby adjust the plane of the sole plate 16 relative to the ground surface to vary the vertical attack angle of the screed. Under normal operating conditions the sole plate 16 is tipped upwardly slightly at the front for a positive angle of attack.

Figure 2:
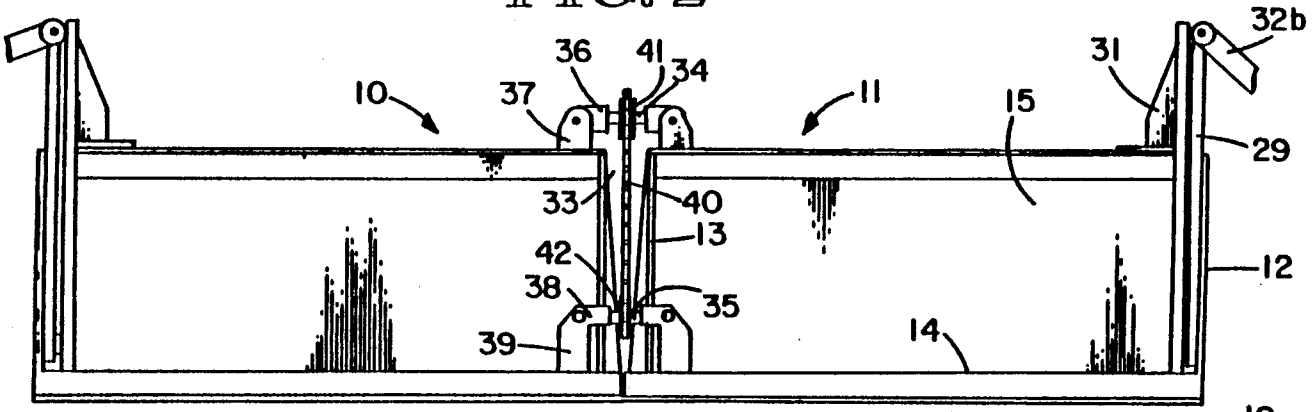
FIG. 2 is a rear elevational view of the screed unit.

It will be noted from FIG. 2 that the opposed inner edges of the moldboard members 15 and the opposed inner edges of the upturned flanges 17*c* and rounded nose portions 17*b* of the bullnose members 17 diverge from the plane of the bottom face of the sole plate 16 to form a V-shaped gap 33. This gap is provided to permit downward dishing of the sole plate 16 to be performed as will now be explained.

Adjustment is provided for raising or lowering the center of the sole plate 16 relative to the lateral sides so that the sole plate can be dished upwardly to conform with a crown in the road, or can be dished downwardly to provide a valley to serve as drain area for a parking lot, for example. This adjustment is accomplished by operation of front and back laterally extending jack screws 34, 35. The front jack screw extends to two nuts 36 mounted between two pairs of ears 37 anchored to the two moldboard members 15, and the back jack screw 35 extends to two nuts 38 mounted between two other pairs of ears 39 anchored to the deck plates 14. These two jack screws 34, 35 can be operated in unison by way of a chain 40 extending around sprockets 41, 42 mounted on the jack screws. The chain 40 can be driven by a reversible motor (not shown), or a second motor driven sprocket can be provided for the front jack screw 34.

Each jack screw 34, 35 has threaded end portions of opposite hand which screw into the respective nuts 36, 38. Hence, when the jack screws 34, 35 are turned in unison responsive to driving of the chain 40, the two frame sections 10, 11 are pulled toward one another or pushed apart depending on the selected direction of rotation of the jack screws, thereby responsively dishing the sole plate 16 downwardly or upwardly.

It has been found to be advantageous under normal highway paving conditions to dish the sole plate 16 upwardly more at the front than at the rear. This is accomplished by initially preloading the front of the sole plate by manually turning the forward jack screw 34 to extend the distance between the nuts 36 with the chain 40 disconnected. This preloading is maintained when the chain 40 is reconnected.

As indicated in FIG. 4, screed extenders may be mounted at the front of the main screed unit behind the auger in the manner disclosed in Patent 4,818,140. The extenders are slide supported on the moldboard members 15 and ride near the bottom along guide plates (not shown) which are bolted in position covering a lower portion of the front face of the moldboard members and most of the front face of the upturned bullnose flanges 17*c*. Slots 43 are provided in the moldboard members 15 to receive the bolts for mounting the guide plates for the screed extenders.

By way of the present invention the sole plate 16 of the main screed is provided with two sets of heat exchange tubes 46, one for each half, covered with insulating blankets 47. The tubes 46 are preferably rectangular in cross-section so as to rest flat against the upper face of the sole plate. For example, the tubes may be mild steel square tubing 0.5 inch wide on each outer face and having a wall thickness of 0.0625 inch. The heat exchange tubes are spot welded on each half of the sole plate 16 at regular intervals in position to form a respective serpentine path (FIG. 3) having straight parallel sections 46*a* extending lengthwise of the screed which are joined by carved end sections 46*b*. In the case of a typical main screed having a sole plate 10 feet long and about 26 inches wide, the straight sections of the tubing may be spaced about 3.5 inches apart and be located in about the back 15 inches of width of the sole plate where most of the preheating is needed.

Figure 6:
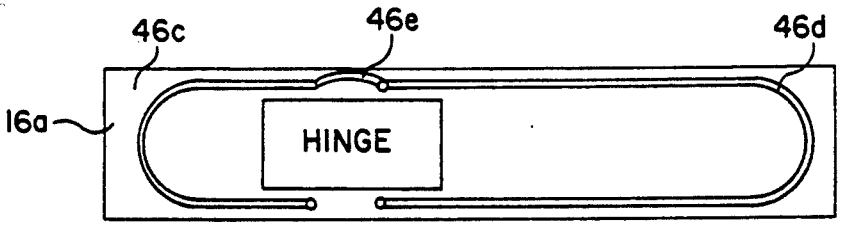
FIG. 6 is a plan view illustrating the layout of the heat exchange tubes on the sole plate of a screed extender.

Like tubing is also mounted on the upper face of the sole plates on the extension screeds as indicated in FIG. 6. A typical sole plate 16*a* for an extension screed may have a width of about 8 inches and a length of about 44 inches. If, as indicted in FIG. 6, the sole plate is articulated for berm formation and has hinge assembly such as shown in Patent No. 4,818,140, it is preferred to provide single loops of tubing 46*c*, 46*d*, on the sole plate sections and to interconnect the loops by a flexible hose 46*e* which loops horizontally around the hinge assembly. One of the loops 46*c*, 46*d* is connected by a flexible supply hose 48 to one end of the heat exchange tubing on the adjoining half of the main screed, and the other end is connected by a flexible return hose 49 to a reservoir 50. Right-angle nipple fittings 51 are fixed to the ends of the heat exchange tubing on the sole plates to present upstanding nipples to receive swivel socket connections on the related hoses.

Figure 7:
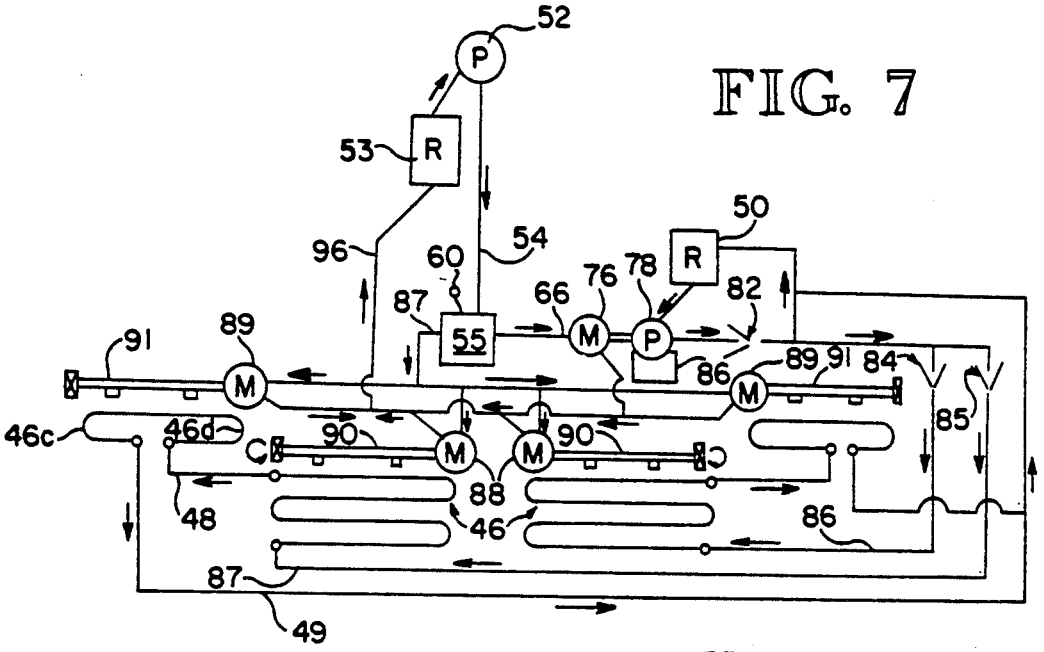
FIG. 7 is a schematic of a hydraulic system for the main screed and screed extenders utilizing the present invention.
Figure 8:
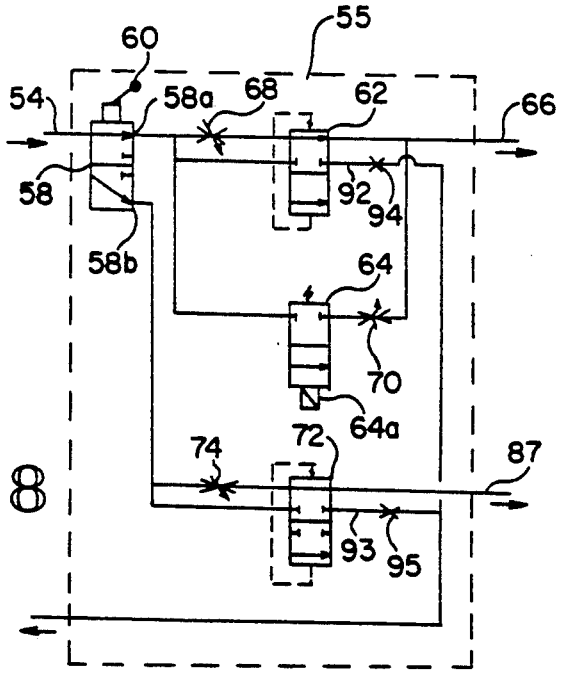
FIG. 8 is a schematic of the selector unit.

Directing attention to FIG. 7, the tractor for an asphalt paver normally has a hydraulic pump 52 for power take-off which is usually driven off the tractor engine and is supplied with oil from a reservoir 54 on the tractor. The pump 52 is either a variable displacement type operating in a closed center system, or is a constant displacement type operating in an open center system. In accordance with the present invention the output from the pump 52 is connected by a hose 54 to a selector unit 56 shown schematically in FIG. 8. This selector unit has a selector valve 58 operated by a handle 60 which alternately connects with a heat system port 58*a* or a vibrator system port 58*b*. The port 58*a* is connected to a shuttle valve 62 and a solenoid operated valve 64 arranged in parallel for controlling supply to a heat system supply line 66. Flow to valve 62 is controlled by a variable flow restrictor 68, and flow from the solenoid 64 valve is controlled by a restrictor 70. The port 58*b* for the vibrator system is connected to a valve 72 via a variable restrictor 74.

The heat system supply line 66 connects to a hydraulic motor 76 which drives a high pressure hydraulic pump 78 taking suction from the reservoir 50 which can be a small tank. Output from the pump 78 flows through a primary flow restrictor 82 which functions to heat the oil responsive to a pressure drop across the restrictor. Most of the heated oil from the restrictor 82 returns directly to the reservoir 50 and the balance is divided into two like circuits at needle valves 84, 85 leading by flexible hoses 86, 87 to input ends of the heat exchange tubes on the two halves of the sole plate of the main screed. The hot oil continues from the main screed to the heat exchange tubes on the screed extenders by flexible hoses 48 and then returns to the reservoir 50.

The pump 78 preferably has an output pressure of about 550 psi and an output flow of about 10 gal/min. The needle valves 84, 85 are preferably set so that about 0.5 gal/min of heated oil passes through each of them; the balance returns directly from the primary restrictor 82 to the reservoir 80. The heating system is so efficient that only about three quarts of oil is required in the reservoir 50. The reservoir should also contain an air space which may, for example be equivalent in volume to about one-third of that occupied by the oil.

The solenoid 64*a* for the valve 64 in the selector unit is connected in series with the switch of a heat sensor 86 which is preferably mounted on the outside of the housing of the high pressure pump 78 to sense the pump temperature so as to prevent overheating of the pump. The switch of the heat sensor 86 is normally closed and opens responsive to a heat overload condition, thereby causing deactivation of the solenoid 64*a* to move the spring-loaded spool of the valve 64 to the closed no-flow position shown in FIG. 8. This results in flow through the restrictor 68 and valve 62 to the hydraulic motor 76 at a reduced rate as compared to flow through the valve 64 and restrictor 70 to the motor 76 when valve 64 is open. This reduced flow to the motor 76 slows the motor and reduces its output to a level at which the output pressure of the pump 78 is reduced to an extent at which a negligible amount of heat is generated at the primary restrictor 82, but circulation of the previously heated oil continues through the heat exchange tubes at a reduced rate. When the motor 76 cools below the preset triggering temperature for the sensor 86 the sensor switch again closes thereby reenergizing the solenoid 74*a* to again open the valve 74 for flow via restrictor 70 to the motor 76. This results in a cutoff of flow through the valve 62.

When the screeds have been heated sufficiently with respect the hot asphalt material to be spread, the operator moves handle 60 to shift the selector valve 59 to its alternate position whereat the oil from the pump 52 on the tractor is diverted to a vibratory circuit supply line 87 via the restrictor 74 and the valve 72. Supply line 87 supplies pressurized oil to drive hydraulic motors 88 on the main screed and hydraulic motors 89 on the screed extenders. These motors 88, 89 drive respective conventional vibratory units 90, 91 on the main screed and screed extenders. Which comprise rotary shafts carrying eccentrics.

When the supply pump on the tractor is a variable displacement type, only return from the motors in the heating and vibratory systems is needed. In that case return lines 92, 93 provided the selector unit from the valves 62, 72 are closed as indicated at 94, 95. On the other hand, if the supply pump is a constant displacement pump the closures 94, 95 are not used since return flow from the valves 62 and 72 is then required because the input to the control valve 62 normally exceeds flow through the restrictor 68 during operation of the heating system, and exceeds flow through the restrictor 74 during operation of the vibratory system. Hence, when valve 64 is closed the valve 62 shuttles to a position in which the excess oil passes therethrough via branch 90 of the circuit to connect to the return line. Similarly, when the vibratory system is in operation, the valve 72 shuttles to a position in which the excess oil passes therethrough via branch line 91 to return to the tractor reservoir. When use of the return lines 92, 93 is required, they are connected to the return hose 96 lending back to the reservoir 53 on the tractor from the hydraulic motors 89, 90.

I claim:

1. A heating system for the sole plate of a screed on a paving machine, comprising:

a heat exchanger tube mounted directly in engagement with the upper surface of the sole plate;

a pump;

a flow reservoir;

a flow restrictor; and a heating circuit connecting the heat exchange tube, reservoir, pump and flow restrictor so that liquid from the reservoir is pressurized by the pump to flow through the flow restrictor to the heat exchange tube and undergo a pressure drop at the flow restrictor resulting in heating of the fluid for heat transfer through the heat exchange tube to the sole plate.

2. A heating system according to claim 1 in which said heat exchange tube have a flat bottom surface engaging the upper surface of said sole plate.

3. A heating system according to claim 2 in which said heat exchange tube is rectangular in cross-section.

4. A heating system according to claim 1 in which said screed comprises two screed sections hinged together for relative up and down swinging movement, and there is a respective such heat exchange tube on each of said screed sections which are connected together for flow from one to the other.

5. A heating system according to claim 1 in which said pump is driven by a hydraulic motor, and in which said paving machine has a second reservoir, a second pump, and motor means for driving said second pump, and has a hydraulic circuit connecting said second reservoir, second pump, and hydraulic motor for operating said first-mentioned pump.

6. A heating system according to claim 5 in which said paving machine has a tractor coupled to said screed, and in which said second pump and motor means are mounted on said tractor, and said heating circuit is mounted on said screed.

7. A heating system according to claim 5 in which said screed has a vibratory unit driven by a second hydraulic motor in a vibratory circuit, and in which said hydraulic circuit includes a control valve for selectively operating said heating circuit or said vibratory circuit

8. A screed for an asphalt paving machine comprising:

a sole plate with a bottom sole surface and a top surface;

means for flexing said sole plate;

a heat exchange tube mounted directly onto said top surface for containing a liquid, said tube being adapted to flex with said sole plate; and means for heating a liquid and circulating the heated liquid through said heat exchange tube.

9. A screed according to claim 8 in which said sole plate and heat exchange tube are steel, and the heat exchange tube has a flat side seated on said top surface of the sole plate.

10. A screed according to claim 9 in which said heat exchange tube is spot welded to said sole plate.

11. Apparatus for a paving machine, comprising:

a screed;

means including a pump and a flow restrictor in series for circulating fluid under pressure through said flow restrictor to heat said fluid, and for circulating said heated fluid at reduced pressure through a tube which is in direct heat transfer relation to said screed for responsively heating the screed.

12. A combination heating system and vibratory system for a screed coupled to a tractor on an asphalt paving machine, comprising:

a selector valve on the screed;

a pressurized oil supply circuit to said selector valve from the tractor;

a screed-heating hydraulic circuit on the screed connected to said selector valve; and a vibratory unit on the screed driven by a hydraulic motor in a vibratory hydraulic circuit connected to said selector valve;

said selector valve being adapted to connect said supply circuit to said screed-heating circuit or to said vibratory circuit.

13. A combination according to claim 12 in which said screed-heating circuit includes a second hydraulic motor arranged to be operated by pressurized oil from said supply circuit, a high pressure pump driven by said second hydraulic motor, a flow restrictor arranged to cause a pressure drop in the output liquid from said high pressure pump to thereby heat the output liquid, and a heat exchange unit in direct heat exchange relationship with the sole plate of the screed for transferring heat from said heated output liquid to said sole plate.

14. A combination according to claim 13 which said heat exchange unit comprises a heat exchange tube mounted on said sole plate.

15. A screed unit for an asphalt paving machine comprising:

two side-by-side frame units;

a sole plate secured to said frame units and extending across the bottom of the screed unit beneath said frame units;

two heat exchange tubes mounted on said sole plate beneath respective of said frame units for use in preheating said sole plates, and means for moving said frame units relative to one another to flex said sole plate, said heat exchange tubes being adapted to flex with said sole plate.

16. A screed unit according to claim 15 in which thermal insulation covers the top of said heat exchange tubes between said frame units and heat exchange tubes.

17. A screed unit for an asphalt paving machine comprising:

a sole plate having front and back ends, two opposite lateral sides between said ends, an upper surface, and a bottom surface for engaging asphalt on a roadway;

means for flexing one lateral side of said sole plate relative to the other lateral side thereof; and a heat exchange tube mounted in direct engagement with said upper surface of the sole plate and having a serpentine path on said upper surface.

18. A screed unit according to claim 17 in which said heat exchange tube is rectangular in cross-section and has one of its side faces seated against said upper surface of the sole plate.

19. A screed unit according to claim 18 in which said sole plate and heat exchange tube are steel, and said tube is weld-connected to the sole plate.

* * * * *

UNITED STATES PATENT AND TRADEMARK OFFICE

CERTIFICATE OF CORRECTION

PATENT NO. : 5,259,693

DATED : November 9, 1993

INVENTOR(S) : Larry Raymond

It is certified that error appears in the above-identified patent and that said Letters Patent is hereby corrected as shown below:

In column 6, claim 2, line 38, please delete "have" and substitute therefor --has--.

Signed and Sealed this

Second Day of August, 1994

Bruce Lehman

*Attest:*

BRUCE LEHMAN

*Attesting Officer*

*Commissioner of Patents and Trademarks*